US005232336A

United States Patent [19]

Baer et al.

[11] Patent Number: 5,232,336

[45] Date of Patent: Aug. 3, 1993

[54] DRUM ROTOR FOR AXIAL FLOW TURBOMACHINE

[75] Inventors: Hermann Baer, Waldshut, Fed. Rep. of Germany; Hans Meyer, Fislisbach, Switzerland; Ui-Liem Nguyen, Neuenhof, Switzerland; Peter Novacek, Gebenstorf, Switzerland; Paul Slepcevic, Nussbaumen, Switzerland

[73] Assignee: Asea Brown Boveri Ltd., Baden, Switzerland

[21] Appl. No.: 904,668

[22] Filed: Jun. 26, 1992

[30] Foreign Application Priority Data

Jun. 28, 1991 [CH] Switzerland ..... 1923/91

[51] Int. Cl.[5] ..... F04D 29/66

[52] U.S. Cl. ..... 415/119; 416/198 A

[58] Field of Search ..... 415/119, 912; 416/215, 416/216, 217, 198 A

[56] References Cited

U.S. PATENT DOCUMENTS

| | | | |
|---|---|---|---|
| 941,389 | 11/1909 | Snyder | 416/198 A |
| 3,680,979 | 8/1972 | Hansen et al. | 416/198 A |
| 4,872,307 | 10/1989 | Nakhamkin | 60/727 |

FOREIGN PATENT DOCUMENTS

| | | | |
|---|---|---|---|
| 1024983 | 2/1958 | Fed. Rep. of Germany . | |
| 2408641 | 8/1975 | Fed. Rep. of Germany | 415/912 |
| 15893 | of 1909 | United Kingdom | 416/193 A |

*Primary Examiner*—John T. Kwon

*Attorney, Agent, or Firm*—Oblon, Spivak, McClelland, Maier & Neustadt

[57] ABSTRACT

In a drum rotor for an axial flow turbomachine, the blades are fastened via their roots (22) in circumferential blade grooves (1–13) with support indentations at the side. A circumferential forward groove (0), which is not fitted with blades, is located upstream of the first blade groove (1). This forward groove (0) is fitted with axially split closing segments (24).

6 Claims, 1 Drawing Sheet

DRUM ROTOR FOR AXIAL FLOW TURBOMACHINE

BACKGROUND OF THE INVENTION

1. Field of the Invention

The invention concerns a drum rotor for an axial flow turbomachine in which the blades are fastened by means of their roots in rows in circumferential blade grooves with support indentations at the side.

2. Discussion of Background

Such blade fastening arrangements are usually found in compressor and turbine rotors. During each rotation of the rotor, the circumferential blade grooves alter their axial dimension due to rotor bending. The change in dimension takes place with an amplitude which depends on the particular design. If the amplitude exceeds a certain magnitude, damage due to frictional fatigue can occur on the blade roots or on the turned recesses on the rotor. The corresponding parts of the first turbomachine stage in multi-stage machines are particularly endangered because there is no mutual relief provided by adjacent blade grooves. In consequence, noticeably larger relative displacement amplitudes occur in this first blade groove compared with those in the subsequent blade grooves. This matter is explained in FIGS. 2 and 3, which will be described later.

In addition, strong asymmetrical displacements occur in the first blade groove during changes in temperature, on starting or in the case of load changes or of operational fluctuations. These displacements lead to excessive local surface pressures in the blade root support indentations of the first rotor row.

SUMMARY OF THE INVENTION

Accordingly, one object of the invention is to avoid all these disadvantages and, in rotors of the type mentioned at the beginning, to propose a measure by means of which the axial displacement and the asymmetrical deformation of the first groove with fitted blades are at least approximately reduced to the corresponding amount for the second blade groove.

According to the invention, this is achieved by locating a circumferential forward groove, which is not fitted with blades, upstream of the blade groove provided for the first blade row.

It is desirable for the forward groove to be fitted with axially split closing segments. The actual closing of the forward groove prevents the supply of heat which would lead to asymmetrical deformations. The axial split in the closing segments has the advantage that the two halves can follow the relative motions of the support shoulders unhindered.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying schematic drawings of an illustrative embodiment of the high pressure rotor of an axial flow steam turbine, wherein.

DESCRIPTION OF THE PREFERRED EMBODIMENTS

Figure 1:
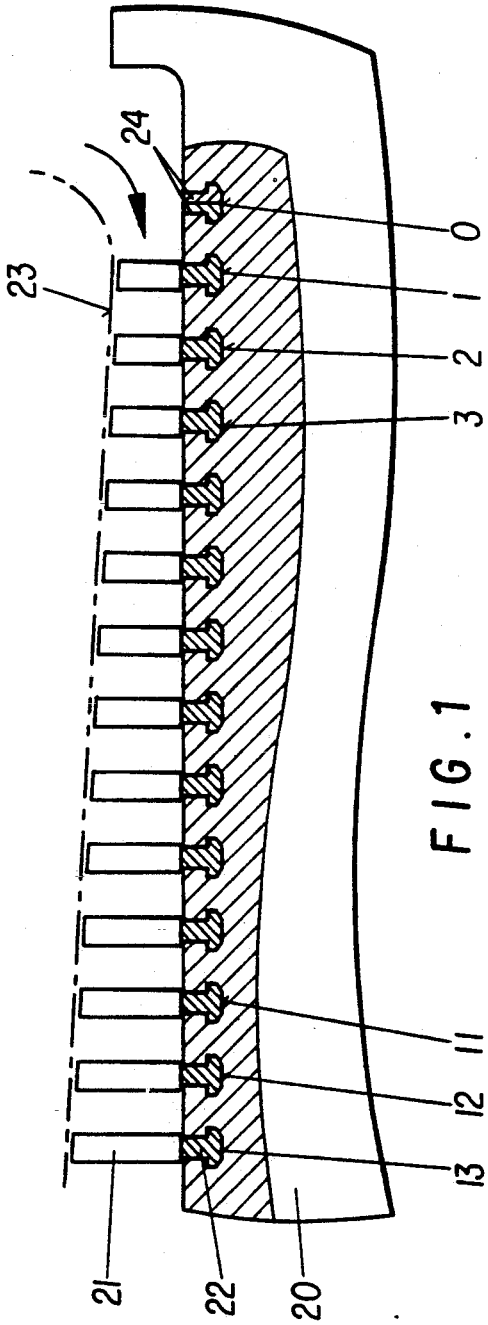
FIG. 1 shows a partially sectioned partial view of a bladed drum rotor.

Referring now to the drawings—wherein like reference numerals or letters designate identical or corresponding parts throughout the several views, where only the elements essential to understanding the invention are shown (not shown, for example, are any of the non-rotating parts of the installation and the shaft ends and bearings) and where the flow direction of the working medium is indicated by an arrow—the high pressure rotor 20 shown in FIG. 1 is provided with thirteen rotor rows spaced along the rotor axis. The individual blades, consisting of blade aerofoil 21 and blade root 22, are inserted in circumferential blade grooves which are numbered from 1 to 13 from the steam inlet end to the steam outlet end. The contour 23 of the cylinder (not shown) forming the flow boundary is shown chain-dotted. Said cylinder similarly carries 13 rows of nozzle guide vanes. The blade roots 22 are of inverted T shape. The centrifugal forces and bending moments acting on the blade in operation are fed into the rotor by means of shoulders via correspondingly configured support indentations of the blade groove, which are integral with the drum.

Figure 2:
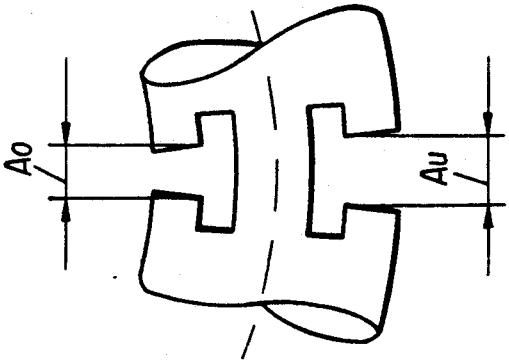
FIG. 2 shows, greatly exaggerated for clarity, the dimensional change, mentioned at the beginning, of a circumferential groove during rotor bending.

The deformation of the blade groove is shown in FIG. 2 by means of a rotor detail. The dimensions Ao and Au are taken at the transition between the vertical and horizontal side wall of the turned recess. This transition is located opposite to the position of the inverted T which is subject to the highest stresses, for which reason the vertical and horizontal parts of the blade root are generally provided with a radius.

Figure 3:
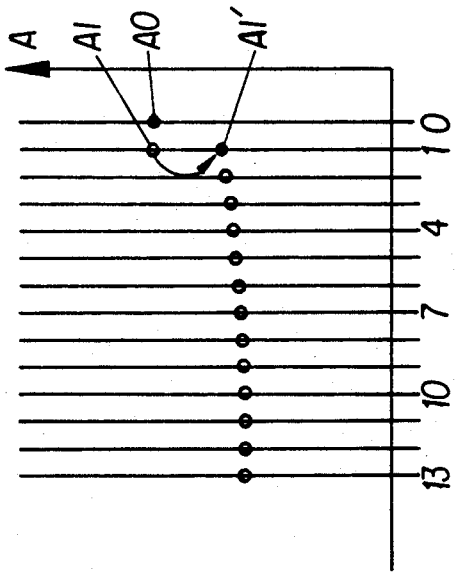
FIG. 3 is a diagram which shows the extent of the resulting bending amplitude in the respective blade grooves.

The amplitude A is given in FIG. 3 as the arithmetic average of the two distances Ao and Au for each of the 13 blade grooves. If no counter-measures are taken, the value A1 of the axial displacement of the first blade groove is substantially higher than those of the adjacent blade grooves.

It is at this point that the invention is applied. It consists in the fact that a circumferential forward groove 0, which is not fitted with blades, is provided upstream of the first blade groove 1.

The axial distance between the upstreammost or forward groove 0 and the first blade groove 1 is substantially the same as that between the first two blade grooves 1 and 2. In addition, it has the same radial depth as the immediately adjacent blade groove 1. These two measures have the effect that the agglomeration of rotor material located between the forward groove 0 and the blade groove 1 corresponds to the volume of material which is present in the region of the rotor surface between the first and second blade grooves and which exerts a decisive influence on the flank motions of the blade grooves. Although not imperative for the effect of the invention, equal groove depths and equal distances between the grooves are thus the optimum values for achieving an axial displacement which is as deep as possible for a given design, such as is fundamentally fixed by the blade grooves 1–13.

Finally, the forward groove 0 also has the same geometry as the immediately adjacent blade groove 1, which has a favorable effect on the manufacturing costs.

Figure 4:
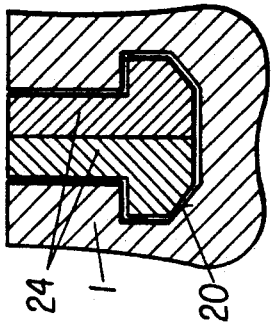
FIG. 4 shows a partial longitudinal section of the forward groove with inserts.

As is shown in FIG. 4, the forward groove 0 is filled with axially split closing segments 24. These so-called blind segments are flush with the surface of the rotor. When the unavoidable axial motions occur, the two halves can follow the relative motions of the support shoulders without difficulty. By this means, a damaging frictional effect can be avoided despite large flank motions in the forward groove 0.

The effect of the new measure can be seen in the diagram of FIG. 3. The relatively large flank motions of amplitude A0 are now found in the forward groove 0 and, in fact, to the same order of magnitude as previously occurred in the blade groove 1 without the measure. In the latter groove, however, the amplitude A1' is reduced to the magnitude usual for the adjacent blade grooves.

Obviously, numerous modifications and variations of the present invention are possible in light of the above teachings. It is therefore to be understood that within the scope of the appended claims, the invention may be practised otherwise than as specifically described herein. Fundamentally any shape of groove is suitable as far as the geometry is concerned, provided the optimum depth critical for the maximum possible effect is appropriately maintained. The filling or closing of the groove can also be done in any given way as long as account is taken of the insulation criterion.

What is claimed as new and desired to be secured by Letters Patent of the United States is:

1. A drum rotor in an axial flow turbomachine providing an axial gas flow in a flow direction, comprising:

a drum positioned in said turbomachine so as to have an axis substantially parallel to the flow direction;

a plurality of circumferential blade grooves formed in said drum and spaced along the axis of the drum, said drum being formed with blade support indentations so as to accept roots of rows of blades in the grooves and secure the blades to the drum; and blades fitted in said grooves and held therein by said support indentations, wherein an upstreammost one of said grooves in the flow direction has none of said blades fitted therein, thereby reducing deformations of said blade grooves.

2. The drum rotor of claim 6, wherein said blade support indentations are integral with said drum.

3. The drum rotor as claimed in claim 1, wherein the upstreammost groove has substantially the same radial depth as the blade groove provided for the first blade row.

4. The drum rotor as claimed in claim 2, wherein the upstreammost groove has substantially the same geometry as the blade groove provided for the first blade row.

5. The drum rotor as claimed in claim 1, wherein the axial distance between the upstreammost groove and the first blade groove fitted with blades is substantially the same as the axial distance between the first blade groove and the second blade groove.

6. The drum rotor as claimed in claim 1, wherein the upstreammost groove is fitted with axially split closing segments.

* * * * *